United States Patent [19]

Silverglate

[11] Patent Number: 4,944,707

[45] Date of Patent: Jul. 31, 1990

[54] RING-LIKE FLYING TOY

[75] Inventor: David E. Silverglate, Santa Cruz, Calif.

[73] Assignee: OddzOn Products, Inc, Campbell, Calif.

[21] Appl. No.: 400,997

[22] Filed: Aug. 31, 1989

Related U.S. Application Data

[63] Continuation-in-part of Ser. No. 324,986, Mar. 15, 1989, abandoned, which is a continuation of Ser. No. 11,145, Feb. 5, 1987, abandoned.

[51] Int. Cl.[5] ..... A63H 27/00

[52] U.S. Cl. ..... 446/48

[58] Field of Search ..... 446/46–48, 446/450, 236, 240; 273/425, 424, 412, 426

[56] References Cited

U.S. PATENT DOCUMENTS

| | | | |
|---|---|---|---|
| 3,254,443 | 6/1966 | Olson | 446/450 |
| 4,174,834 | 11/1979 | Demartino | 446/48 X |
| 4,241,533 | 12/1980 | Newsome | 446/46 |
| 4,290,226 | 9/1981 | Stauffer | 446/46 |
| 4,709,928 | 12/1987 | Willingham | 446/46 X |

*Primary Examiner*—Mickey Yu

*Attorney, Agent, or Firm*—Kolisch, Hartwell & Dickinson

[57] ABSTRACT

A ring-like throwable flying toy including outer and inner, generally concentric, deformable boundary structures, and an air-foil web joined to and tensed between the structures. In all embodiments, the outer structure includes a springy, nominally circular armature that is readily, appreciably impact deformable. And in certain modifications, the inner structure also includes such an armature.

18 Claims, 3 Drawing Sheets

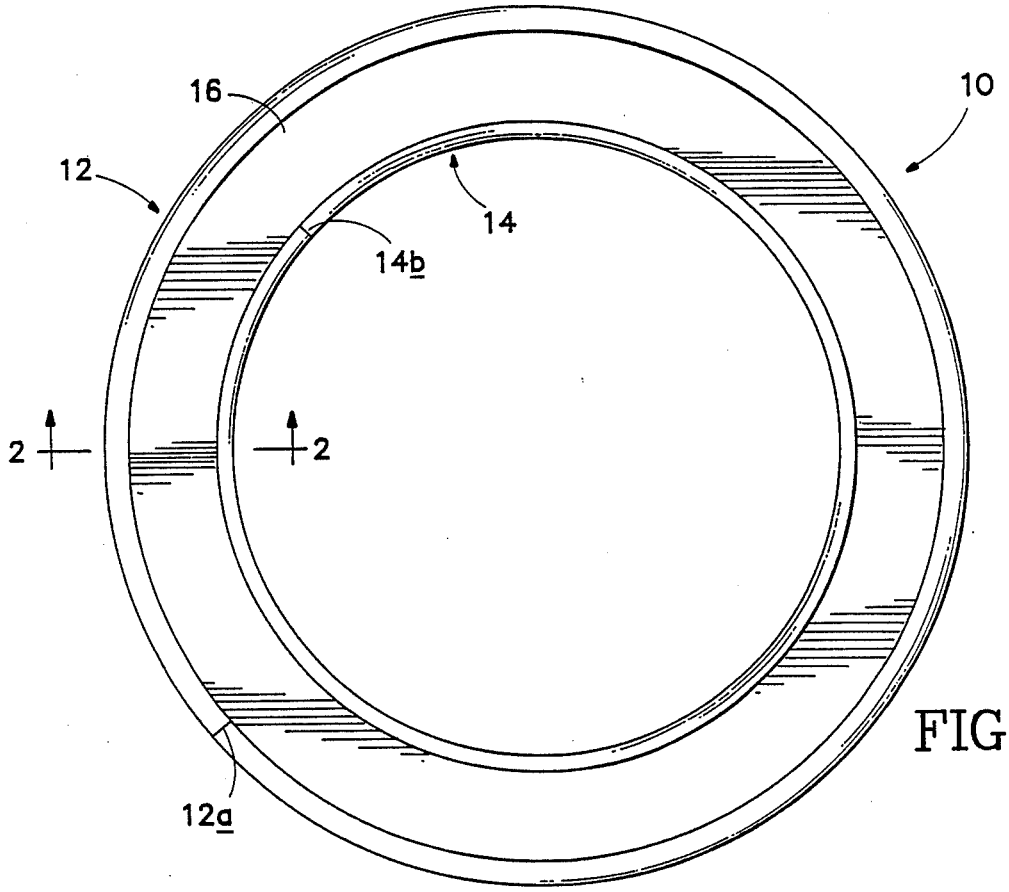
FIG. 1
FIG. 2A
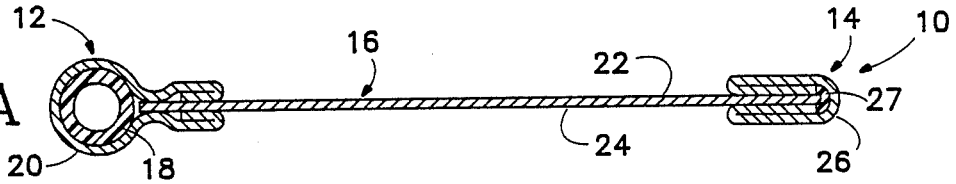
FIG. 2B
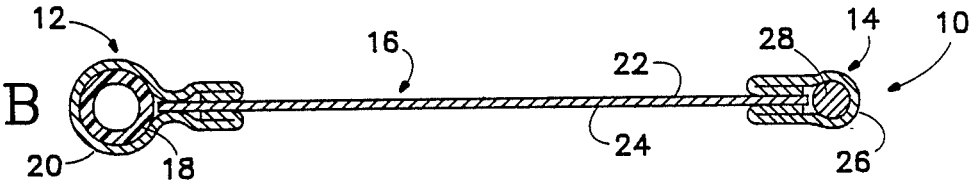
FIG. 2C
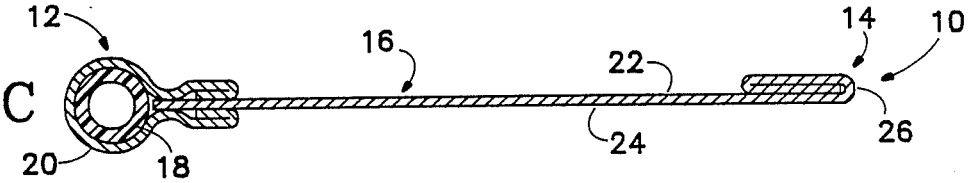
FIG. 2D
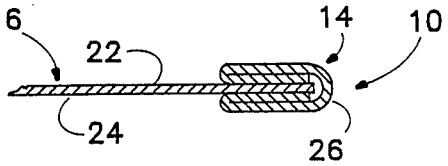

RING-LIKE FLYING TOY

CROSS-REFERENCE TO RELATED APPLICATION

This application is a continuation-in-part of prior copending application Ser. No. 07/324,986, filed on Mar. 15, 1989, abandoned, which is a continuation of Ser. No. 07/011,145, filed Feb. 5, 1987, for FLYING TOY, abandoned.

BACKGROUND AND SUMMARY OF THE INVENTION

The recreational use of flying toys has long been enjoyed by both children and adults. Many popular games involve passing such devices from player to player by hand or by using another device such as a stick.

Examples of flying toys include the Frisbee ® flying disc, described in U.S. Pat. No. 3,359,678, and the Aerobie TM flying ring, described in U.S. Pat. No. 4,560,358. The Frisbee ® flying disc is a saucer-shaped device that can be thrown over relatively long distances. A player throws such a disc by grasping its edge and flexing the wrist, while holding the forearm in a neutral position. Next, the player extends the wrist and releases the disc, i.e. the player "flings" from the wrist, imparting spin to the disc, resulting in its being propelled through the air.

Such a disc will fly over relatively long distances because of its relatively high mass, peripheral mass distribution, and solid/rigid construction and aerodynamic structure.

Like the Frisbee ® flying disc, the Aerobie TM flying ring has a relatively large mass, but, unlike the Frisbee ® flying disc, has a mass which is distributed peripherally about a central void and a special air-foil shape, supposedly offering a unique flying capability.

Still other flying toys are known that offer features different from those of the Frisbee ® flying disc and of the Aerobie TM flying ring. For example, in U.S. Pat. No. 4,174,834 to De Martino, a stick-propelled disc is disclosed which features an annular disc with a circular rim defining an inner opening. The disc also includes a relatively thin central portion and relatively thick inner and outer circumferential edges.

Specifically, the De Martino disc's rim has an inner circumferential edge that is three times the thickness of the rim's central portion, and has an outer circumferential edge that is approximately one and one half times as thick as the rim's central portion. These relational dimensions concentrate the disc's mass toward the center, while still providing a reinforced outer edge. Also, because the central portion is thinner than either edge, it provides an aerodynamic cup for lift purposes. Such structural features are supposed to result in a disc that has a desirably "flatter" trajectory, with the capability of increased travel distance and higher flight speeds.

Other disc-shaped flying toys have been disclosed. For example, in U.S. Pat. No. 4,241,533 to Newsome, and in U.S. Pat. No. 4,832,652 to Matsuyama. In Newsome, an aerial toy glider is disclosed which takes the shape of a floppy fabric disc that is loosely arranged within, and attached to, a flexible weighted rim member. The disc-like shape is supported by the rim member, with the loosely arranged floppy fabric providing a doming effect when the toy is propelled through the air.

In Matsuyama, a disc-shape "joke" toy is disclosed, including an elastic member with a synthetic film stretched over it. The toy folds into several overlapping portions, and stays in that shape until disturbed. The toy is intended to be thrown in its folded condition, and then, upon impact with an object, is designed to unfold "immediately and explosively", in a joking/snapping way, to its original shape.

Totally lacking in the prior art, and highly desirable, is a semi-rigid, infinitely impact-deformable, resilient, ring-like flying toy that is relatively lightweight, and capable of exhibiting quite surprising flight performance. Such a toy offers not only extremely interesting plural-player interaction, but also a unique single-player capability. Amplifying the latter thought, occasionally, only one player is available, and no known flying disc or ring is capable of providing at all satisfactorily for single-player use. To play comfortably with prior-art flying toys, more than one player is required because of the toys' typical long flight distances, rigid, non-memory-deformable constructions, and "die"-upon-impact, flight characteristics.

Also desirable is such a flying toy which allows for indoor play without any significant risk of damage to valuable objects.

Thus, there is a need for a new kind of flying toy which is suitable both for single-player and for multi-player use—one that is sufficiently lightweight, and aerodynamically designed, to allow a player to throw it and then run after it to catch it, or somehow maintain, or modify, its flight characteristics. One way, for example, to keep the toy airborne would be for the player repeatedly to strike the toy in a tangential direction relative to its outer perimeter and in the direction of the toy's rotation, thus maintaining or modifying its flight characteristics.

It is also desirable to provide such a toy which can purposely be thrown at an object, such as a wall, floor, etc., to create a pronounced bounce/flight reaction.

It is therefore an object of the present invention to provide a novel ring-like flying toy that is lightweight and impact-deformable—capable of being thrown by one or more players to create unique, impact-modifiable bounce/flight characteristics.

A further object is to provide such a toy whose air frame and flight surface, while biased to certain nominal conditions are significantly impact-changeable to alter flight characteristics.

Yet another object is to provide a flying toy of the type outlined for safe playing indoors.

One important convenience feature which emerges from meeting the above objectives, is that the resulting toy can easily be twist/folded for carrying in one's pocket and the like.

The present invention achieves the foregoing objects by providing a novel ring-like flying toy including lightweight outer and inner, ring-like boundary structures defining an annular space that is spanned (at least partially) by an air-foil web joined to and tensed between the structures. The web is preferably formed of a multi-directionally stretchable, air-flow permeable fabric material that has elastomeric-memory characteristics.

The toy's boundary structures are readily, appreciably, impact deformable to cooperate with the tensed web in a way leading to unique and surprising flight performance. This key feature of the toy of present invention results from the fact that the outer boundary structure, in particular, collaboratively cooperates, telegraphically, with the air-foil web during flight to reshape itself in infinitely varying ways after a deformity-producing impact with any external object, such as a player's hand, a wall, a floor, etc. When the toy reshapes itself, it effects infinitely springy-changing, and substantial, air-foil-varying configurations which create surprising, aerobatic, rebound flight characteristics.

These and other objects and advantages which are attained by the invention will become more fully apparent as the description that now follows is read in conjunction with the accompanying drawings.

DESCRIPTION OF THE DRAWINGS

FIG. 1 is a plan view of a ring-like flying toy constructed in accordance with the present invention.

FIGS. 2A–2D are nominally cross-sectional views of the toy, taken generally along the line 2—2 in FIG. 1. These figures show four alternative ways of forming the inner air-frame, boundary structure of the invention.

DETAILED DESCRIPTION OF THE INVENTION

Figure 3:
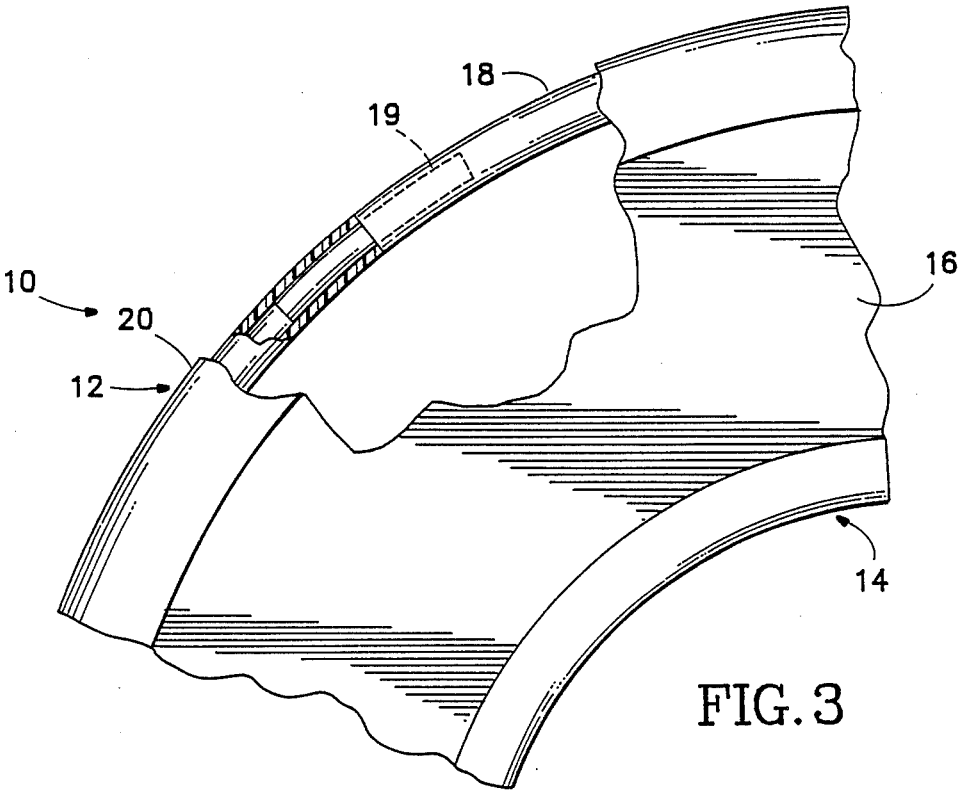
FIG. 3 is an enlarged, fragmentary view of a part of the flying toy shown in FIG. 1 with a portion of the toy broken away to reveal details of construction.

FIGS. 1, 2A–2C, and 3 show a ring-like flying toy 10, also referred to herein as a rebound-active-confounding, ring-like throwable flying toy, that is constructed in accordance with the present invention. The toy includes outer and inner boundary structures 12,14, also referred to herein as air-frame structures. Boundary structures 12,14 are generally concentric relative to one another, defining an annular space between them. The boundary structures are made in a manner, soon to be described, to be springy.

Joined to and tensed between the boundary structures in the annular space therebetween, is an air-foil web 16, also referred to herein as a fabric means or fabric web. Web 16 extends preferably as an annulus within the perimetral confines of boundary structures 12,14. Modifications are possible where the web takes the form of spaced, angularly distributed, fabric segments. Also, the boundary structures, either or both of them, may be formed as distinct-sided polygons. The term "nominally circular" used herein is intended to encompass such a construction. Further, the terms "annular" and "annular space" are intended to define the space between such one or more, non-circular boundary structures. Concentricity, as applied to the two boundary structures, means that their geometric centers are substantially coincident.

The web is made preferably from a multidirectionally stretchable, infinitely-memory-deformable, air-flow permeable material, such as the synthetic material sold under the Lycra® trademark. As will be described shortly, it is the novel combination of such a web, including these important features, tensed relative to the inner and outer boundary structures that forms a central aspect of the present invention.

For aesthetic effect, the peripheral cover may be colored with a fluorescent dye or a design may be printed on it using, for example, a silk screening process.

Focusing on FIGS. 2A–2D, the boundary structures, 12,14 (four embodiments), are shown in more detail. Referring to FIG. 2A, outer boundary structure 12 is fabricated from a circular stay, or stay means (armature), 18, and a peripheral cover 20. Stay 18 must be made from a material that is capable of tensioning web 16, thus to provide an appropriate deformable air foil during flight. In addition, stay 18 must be of a sufficiently low-mass, or lightweight, material to ensure that toy 10 will have a relatively high surface-area-to-mass ratio. Also, it is important that stay 18 be readily and appreciably impact deformable.

In each of the embodiments described herein, stay 18 is fabricated by shaping into a circle a fifty-inch length of Nylaflow brand, Type H, hollow plastic tubing, having an inside diameter of 0.110-inches and an outside diameter of 3/16-inches.

Turning to FIG. 3, stay 18 is closed into a circle by inserting into its ends an elongate coupler 19. To provide a swivel joint necessary for folding the toy as will be described in connection with FIGS. 5A–5B, coupler 19 is fixedly attached, as by adhesive, to the inside of only one end of stay 18, thus allowing the stay's other end to freely rotate around coupler 19.

Peripheral cover 20, employed in each of the three disclosed embodiments, is a relatively thin, elongate section of lightweight, durable material, such a nylon material. It is folded lengthwise and positioned around stay 18, holding the stay in its fold, and fastened to top and bottom surfaces 22,24 of web 16 as by folding its lengthwise edges over and sewing through all of the lengthwise folds and the web. For aesthetic effect, the peripheral cover may be colored with a fluorescent dye or a design may be printed on it using, for example, a silk screening process.

Returning to FIG. 2A, inner boundary structure 14 here is made in the form of an inner cover 26 that includes an elongate section of material folded lengthwise and fastened to the web's top and bottom surfaces, as described earlier in connection with cover 20. Inner cover 26 is preferably made from nylon. Acting as an armature within cover 26 is a suitable tensed elastomer 27.

Turning attention now to the modified boundary structure 14 shown in FIG. 2B, a reinforcer 28, such as a 0.010-inches stainless steel wire is placed lengthwise inside cover 26 after the same is folded and fastened to the web.

Referring to FIG. 2C to describe the third proposed embodiment for structure 14, cover 26 may be integral with web 16 and formed by folding and sewing as shown to top surface 22.

Finally, FIG. 2D shows an inner boundary structure formed solely by cover 26.

Figure 4A:
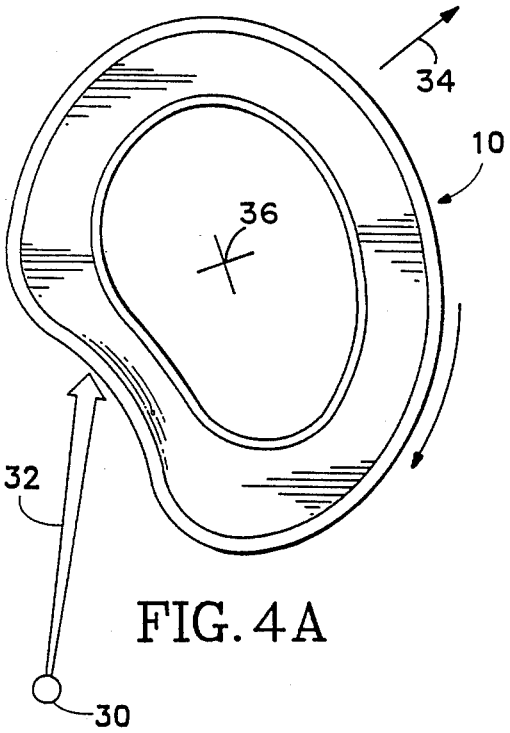
FIGS. 4A–4D illustrate two examples of impact-deforming flight performance.

As was mentioned earlier, FIGS. 4A–4D illustrate two examples of the unique, impact deforming flight characteristics that are obtained with toy 10 due to the cooperation of the boundary structures and web !6. Referring to FIG. 4A, toy 10 is shown flying while it spins in a counterclockwise direction. A player moves his or her hand, shown schematically at 30, in the direction of arrow 32 so that the hand strikes the toy tangentially relative to the toy's ring-like shape. Striking the toy propels it in the direction of arrow 34 and maintains its rotational movement about axis 36.

Figure 4B:
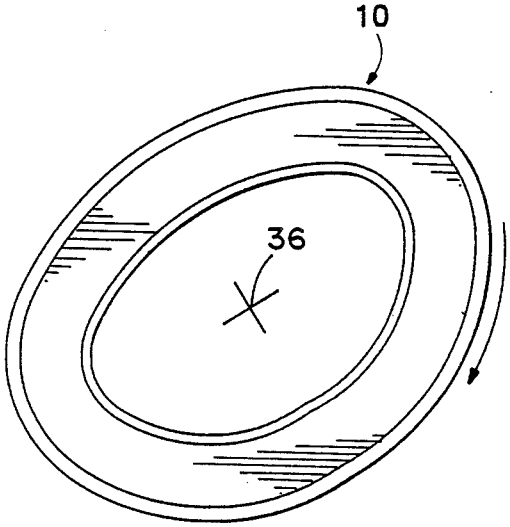

FIG. 4B depicts the toy a short time after it has been struck by the hand. Here, it is easy to see how the elastomeric-memory characteristics of web 16, and the springy characteristic of the boundary structures, cooperate to change the toy's shape from that shown in FIG. 4A (severe distortion) to something approximating, but not identical to, the shape of toy 10 before being struck (refer back to FIG. 1).

Put another way, the elastomeric-memory characteristics of multidirectionally stretchable web 16 and the springy characteristic of the boundary structures result in both springing back when the hand's deforming force is gone. From the severe-distortion impacted condition, the toy recovers towards its original condition, passing through an infinite number of intermediate conditions, each of which imparts a unique and different flight characteristic.

Figure 4C:
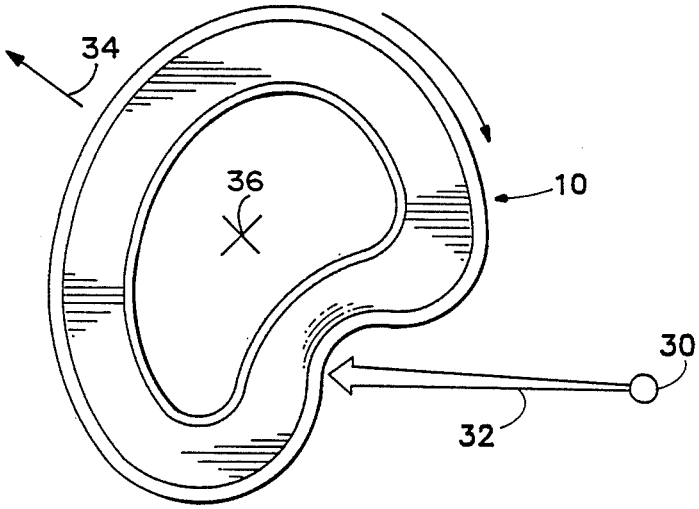
Figure 4D:
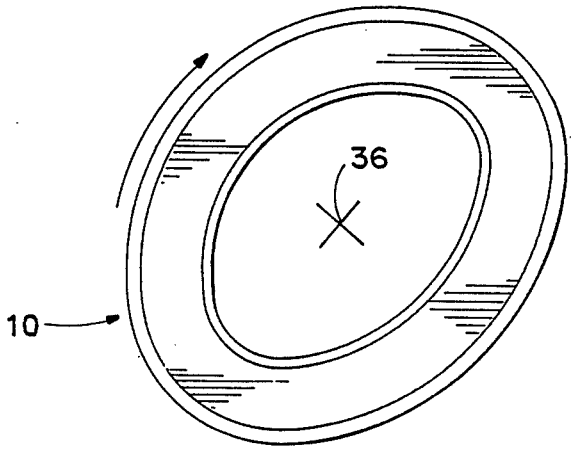

FIGS. 4C and 4D illustrate another impact sequence where toy 10 deforms, and then springs back, or rebounds, through infinitely varying shapes toward its pre-deformation shape.

These two illustrations demonstrate what is meant by the infinitely-memory-deformable characteristics of toy 10 which create infinitely air-foil-varying configurations, and flight performance, as the toy is used.

The cooperative relationship between the springy boundary structures, and the tensed, multidirectionally stretchable web, promote a kind of interesting, confounding flight response as the toy strikes some external (any external) object. On impact, the toy's flight does not simply die. On the contrary, impact causes the toy to fling off in flight in a new, changing, and highly interesting manner.

Such leads to some very interesting playing possibilities as, for example, throwing the toy at the ground, floor or a wall, causing it to bounce dramatically in flight.

The fact that the web is preferably air-flow permeable adds yet another dimension, namely stability, to the toy's fascinating flight behavior.

When toy 10 is played with indoors, its lightweight construction and unique rebound characteristics decrease the risk of breaking objects.

Figure 5A:
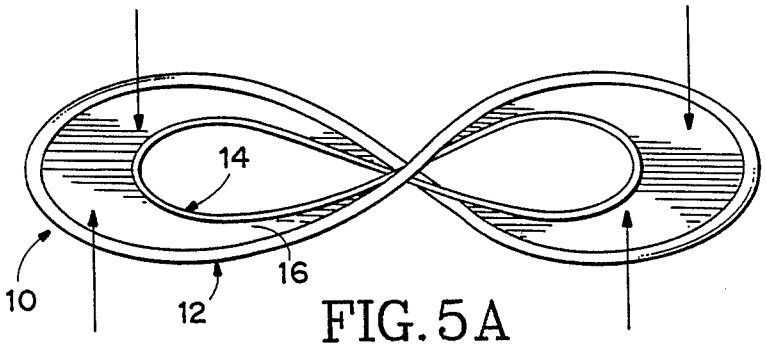
FIGS. 5A,5B show the toy of FIG. 1 being folded for convenient carrying.
Figure 5B:
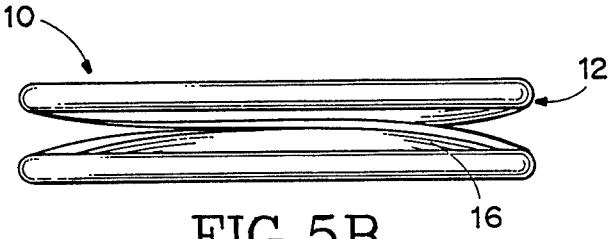

Turning attention now briefly to FIGS. 5A and 5B, toy 10 is shown being folded into a convenient storage/-transport shape. In FIG. 5A, the toy is twisted, in the direction of the arrows, into a "figure-8". Referring back to FIG. 3, the aforedescribed swivel joint between coupler 19 and stay 18 allows the toy to be twisted without "kinking". Turning to FIG. 5B, the toy is folded along an axis transverse to the longitudinal axis of the "figure-8", so that both loops of the "8" overlay one another. The convenience of this capability has been mentioned earlier.

Thus a novel, ring-like flying toy is proposed—a toy exhibiting flight possibilities unattainable in any known prior art device.

I claim:

1. A ring-like flying toy comprising means defining outer and inner, ring-like, generally concentric, deformable boundary structures nominally bounding an annular space, and an air-foil web joined to and tensed between said structures in said space.

2. The toy of claim 1, wherein said outer structure includes a springy, nominally circular armature.

3. The toy of claim 1, wherein said web is formed of a multidirectionally stretchable fabric.

4. The toy of claims or 2, wherein said inner structure includes a fold in said web.

5. The toy of claims 1 or 2, wherein said inner structure includes an elastomeric armature.

6. The toy of claims 1 or 2, wherein said inner structure comprises a springy, nominally circular armature.

7. The toy of claims 1 or 2, wherein said web is air-flow permeable.

8. The toy of claims 1, 2 or 3, wherein said outer structure is readily, appreciably impact deformable.

9. The toy of claims 1, 2 or 3, wherein said web has elastomeric memory characteristics.

10. A ring-like flying toy comprising means defining an outer, deformable, ring-like air-frame structure, and an annular air-foil web joined to said air-frame structure, and residing nominally therewithin in a state of tension.

11. The toy of claim 10, wherein said web is formed of a material having multidirectionally stretchable, elastomeric memory characteristics.

12. The toy of claim 10, wherein said structure is readily, appreciably impact deformable.

13. A flying toy comprising inner and outer, deformable, generally concentric and nominally coplanar rings, and elastomeric, stretchable, air-foil fabric means joined to, spanning the space, and tensed, between said rings.

14. The toy of claim 13, wherein said fabric means is air-flow permeable.

15. A rebound-active-confounding, ring-like, throwable flying toy comprising at least one air-frame structure in the form of a springy, infinitely-memory-deformable, nominally circular boundary structure, and an infinitely-memory-deformable, stretchy, elastomeric-characteristic, air-foil fabric web, joined, and tensed with respect, to, and extending in the form, nominally, of, an annulus within the perimetral confines of said structure, said boundary structure and web collaboratively cooperating telegraphically with one another during flight of the toy, and upon the occurrence of a deformity-producing impact with an external object, to reshape themselves in a memory-returnable manner, and thereafter further cooperating, during memory recovery toward their respective nominal conditions, to effect infinitely, springy-changing, and substantial, air-foil-varying configurations which create interesting, aerobatic, rebound flight characteristics.

16. The toy of claim 15, which further includes a second boundary structure, disposed inwardly of, and placed nominally concentrically with respect to, said first-mentioned boundary structure.

17. The toy of claim 15, wherein said web is multidirectionally stretchable.

18. The toy of claims 15, 16 or 17, wherein said web is air-flow permeable.

* * * * *